US011491627B2

(12) United States Patent
Liou

(10) Patent No.: US 11,491,627 B2
(45) Date of Patent: Nov. 8, 2022

(54) HAMMER TOOL

(71) Applicant: Tang Chou Industrial Co., Ltd., Nantou County (TW)

(72) Inventor: Mou-Tang Liou, Taichung (TW)

(73) Assignee: Tang Chou Industrial Co., Ltd., Nantou County (TW)

( * ) Notice: Subject to any disclaimer, the term of this patent is extended or adjusted under 35 U.S.C. 154(b) by 179 days.

(21) Appl. No.: 16/936,723

(22) Filed: Jul. 23, 2020

(65) Prior Publication Data

US 2022/0024011 A1 Jan. 27, 2022

(51) Int. Cl.
*B25D 1/04* (2006.01)

(52) U.S. Cl.
CPC ..... *B25D 1/045* (2013.01); *B25D 2250/051* (2013.01)

(58) Field of Classification Search
None
See application file for complete search history.

(56) References Cited

U.S. PATENT DOCUMENTS 2,021,490 A * 11/1935 Rigandi ..... B25G 3/28 403/248
2,427,399 A * 9/1947 Fortin ..... B25D 1/00 403/248

FOREIGN PATENT DOCUMENTS

TW 294100 12/1996

* cited by examiner

*Primary Examiner* — Brian D Keller
(74) *Attorney, Agent, or Firm* — Alan D. Kamrath; Karin L. Williams; Mayer & Williams PC

(57) ABSTRACT

A hammer tool includes a head and a handle tightly coupled to the head. The head defines a through hole and a hole connected to the through hole. The hole extends transversely to the through hole. The through hole is of a first width and the hole is of a width greater than the first width. The handle includes a connecting end inserted through the through hole. The connecting end is extruded after inserting through the through hole to include at least one positioning protrusion protruding into the hole. The connecting end is of a second width at where the at least one positioning protrusion is disposed. The second width is greater than the first width.

16 Claims, 6 Drawing Sheets

HAMMER TOOL

BACKGROUND OF THE INVENTION

1. Field of the Invention

The present invention relates to a tool and, particularly, to a hammer tool with a strong connection between a head and a handle.

2. Description of the Related Art

TW Pat. No. 294100 discloses a hammer comprising a head and a handle and including a fixing device for securing the handle to the head. An end of the handle is connected to the head. The handle defines a groove receiving a fixing structure. The fixing structure includes a nail plug with at least one retaining tooth and a nail. The nail plug defines a through hole receiving the nail. The through hole has an inner inclined surface, an entrance at an end of the inclined surface and an outwardly expanding section at the other end. The expanding section has a smaller diametrical size than the nail plug. The nail plug can be forced to expand by the nail so as to secure the handle to the head. The nail plug has a plurality of notches that facilities the expansion thereof.

The above-mentioned fixing structure is only useful when securing a head to a wooden handle. The problem is that the wooden handle wears, deforms and deteriorates easily after a long period of use. Consequently, the fixing effect of the fixing structure is lessened. Even worse, the head can detach from the handle.

The present invention is, therefore, intended to obviate or at least alleviate the problems encountered in the prior art.

SUMMARY OF THE INVENTION

According to the present invention, a hammer tool includes a head and a handle tightly coupled to the head. The head defines a through hole and a hole connected to the through hole. The hole extends transversely to the through hole. The through hole is of a first width and the hole is of a width greater than the first width. The handle includes a connecting end inserted through the through hole. The connecting end is extruded after inserting through the through hole to include at least one positioning protrusion protruding into the hole. The connecting end is of a second width at where the at least one positioning protrusion is disposed. The second width is greater than the first width.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

DETAILED DESCRIPTION OF THE INVENTION

FIGS. 1 through 6 show a hammer tool 10 in accordance with the present invention. The hammer tool 10 includes a head 20 and a handle 30 tightly coupled to the head 20.

Figure 1:
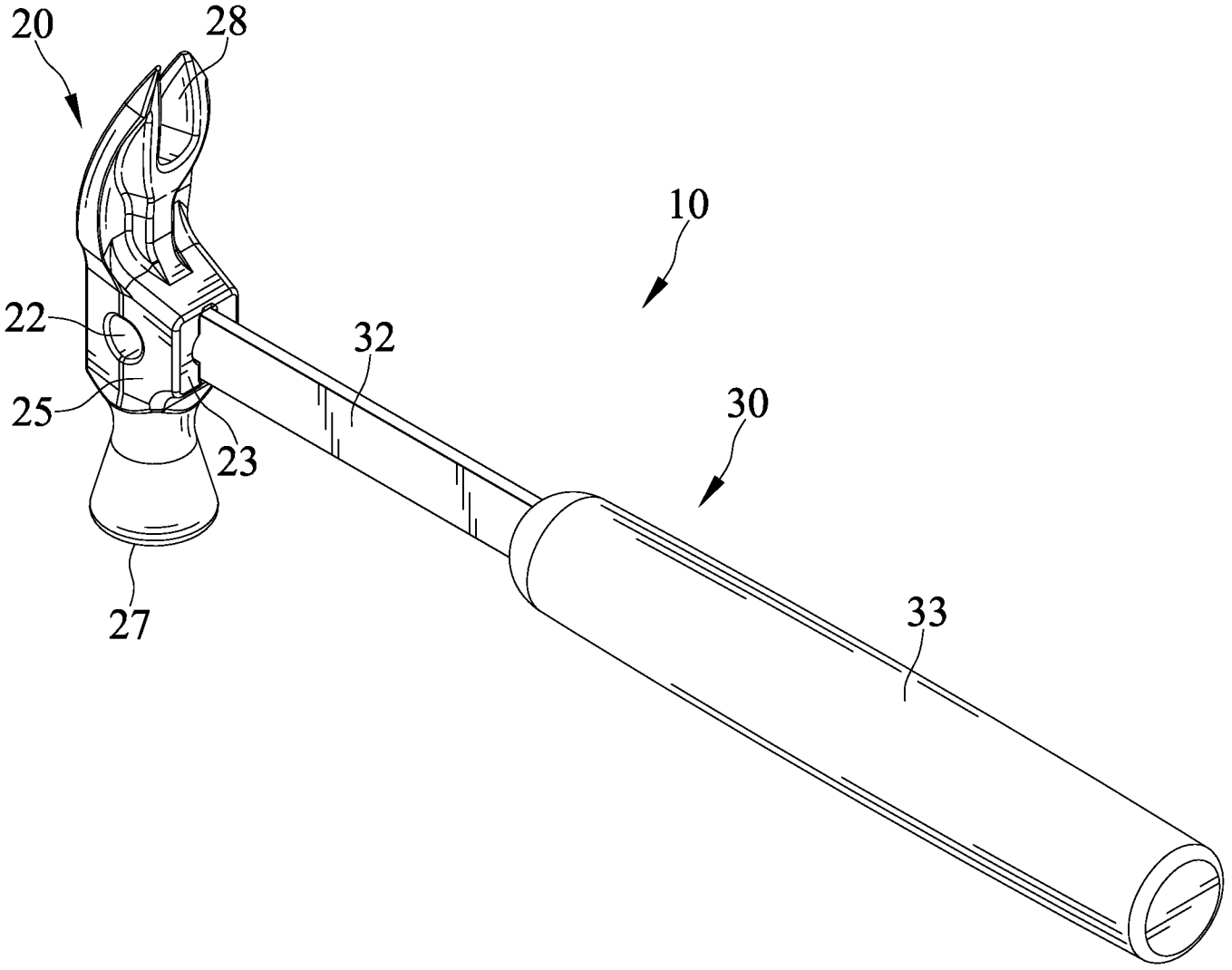
FIG. 1 is a perspective view of a hammer tool in accordance with the present invention.
Figure 2:
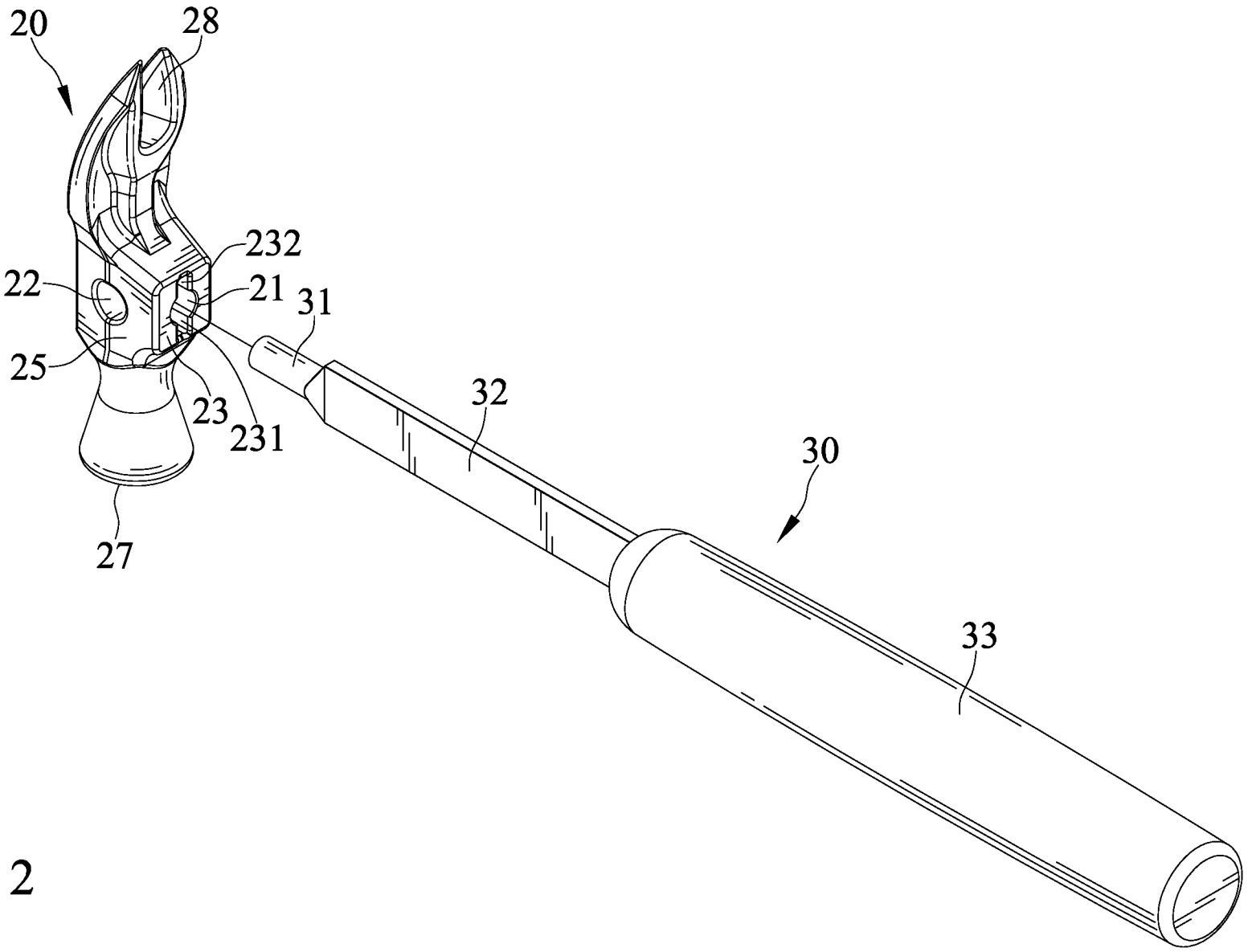
FIG. 2 is an exploded perspective view of FIG. 1.
Figure 3:
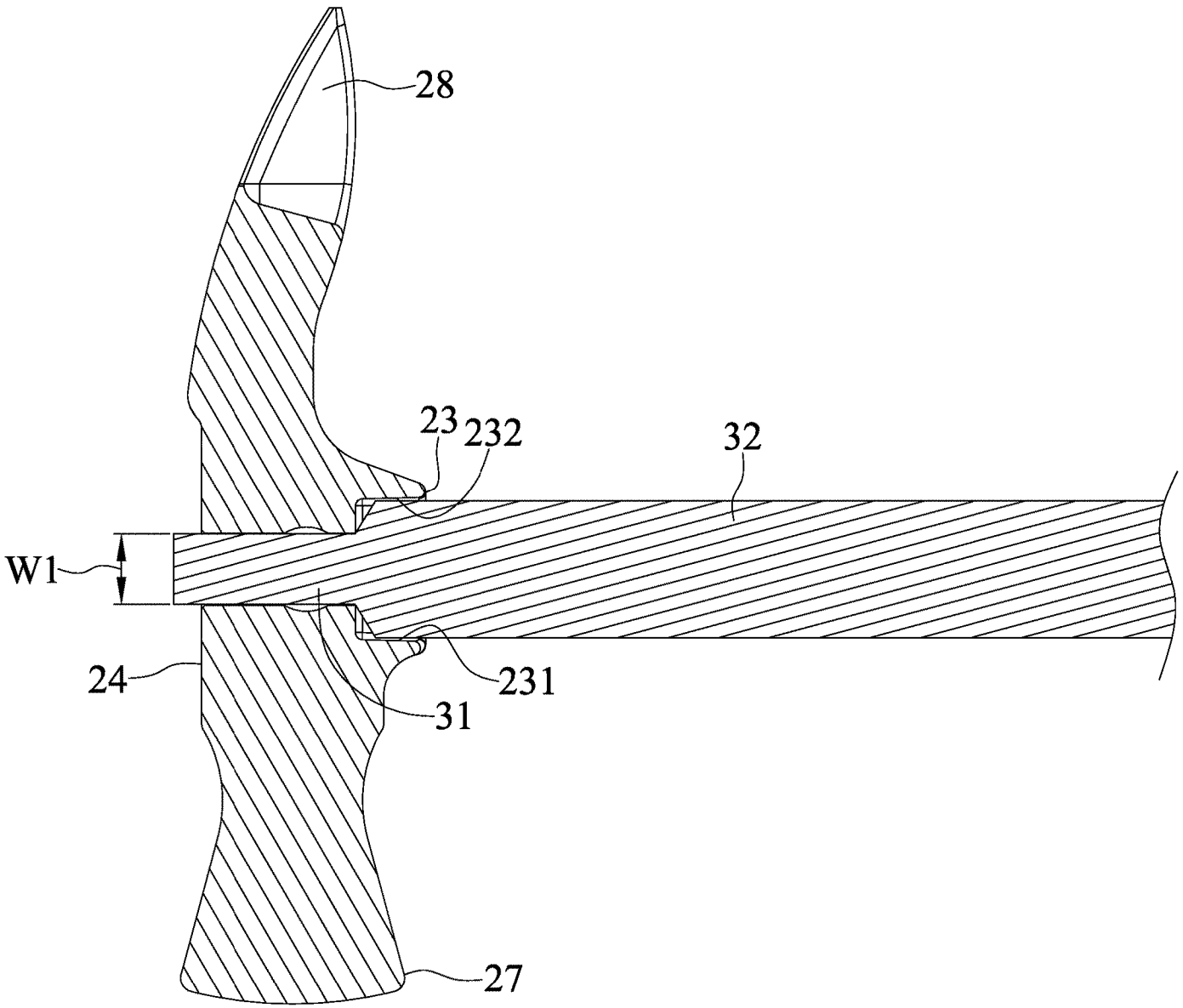
FIGS. 3 and 4 are cross-sectional views of FIG. 1 illustrating a handle inserted into a hammer but not yet secured to a head.
Figure 4:
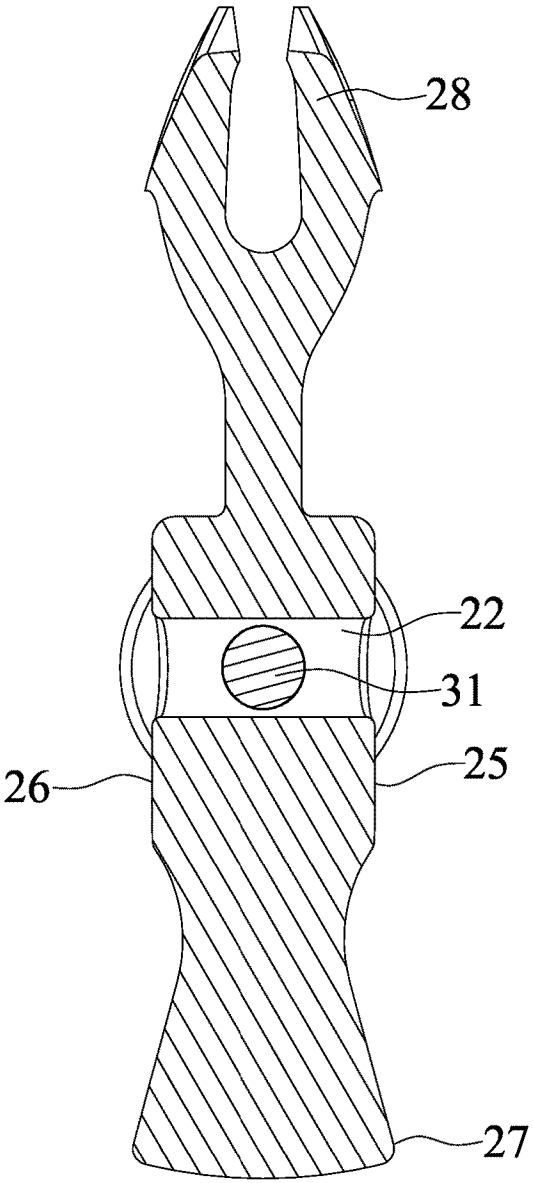

The head 20 defines a through hole 21 and a hole 22 connected to the through hole 21. The hole 22 extends transversely to the through hole 21. The through hole 21 is of a width W1 and the hole 22 is of a width greater than the width W1. The width W1 extends in a radial direction of the through hole 21, as shown in FIG. 3. The width W1 is the maximum width of the through hole 21. The through hole 21 and the hole 22 are circular holes.

The head 20 has an end 23 and an end 24 at opposite ends and a lateral side 25 and a lateral side 26 at opposite sides. The through hole 21 extends through the ends 23 and 24 of the head 20 and the hole 22 extends through the lateral sides 25 and 26 of the head 20 respectively.

The head 20 has a working portion 27 at an end and a working portion 28 at another end. The working portions 27 and 28 are disposed oppositely in a first direction and the through hole 21 extends in a second direction transverse to the first direction. The working portion 27 has a striking face. The second working portion 28 is a claw which is adapted to be used to pry an object.

Figure 5:
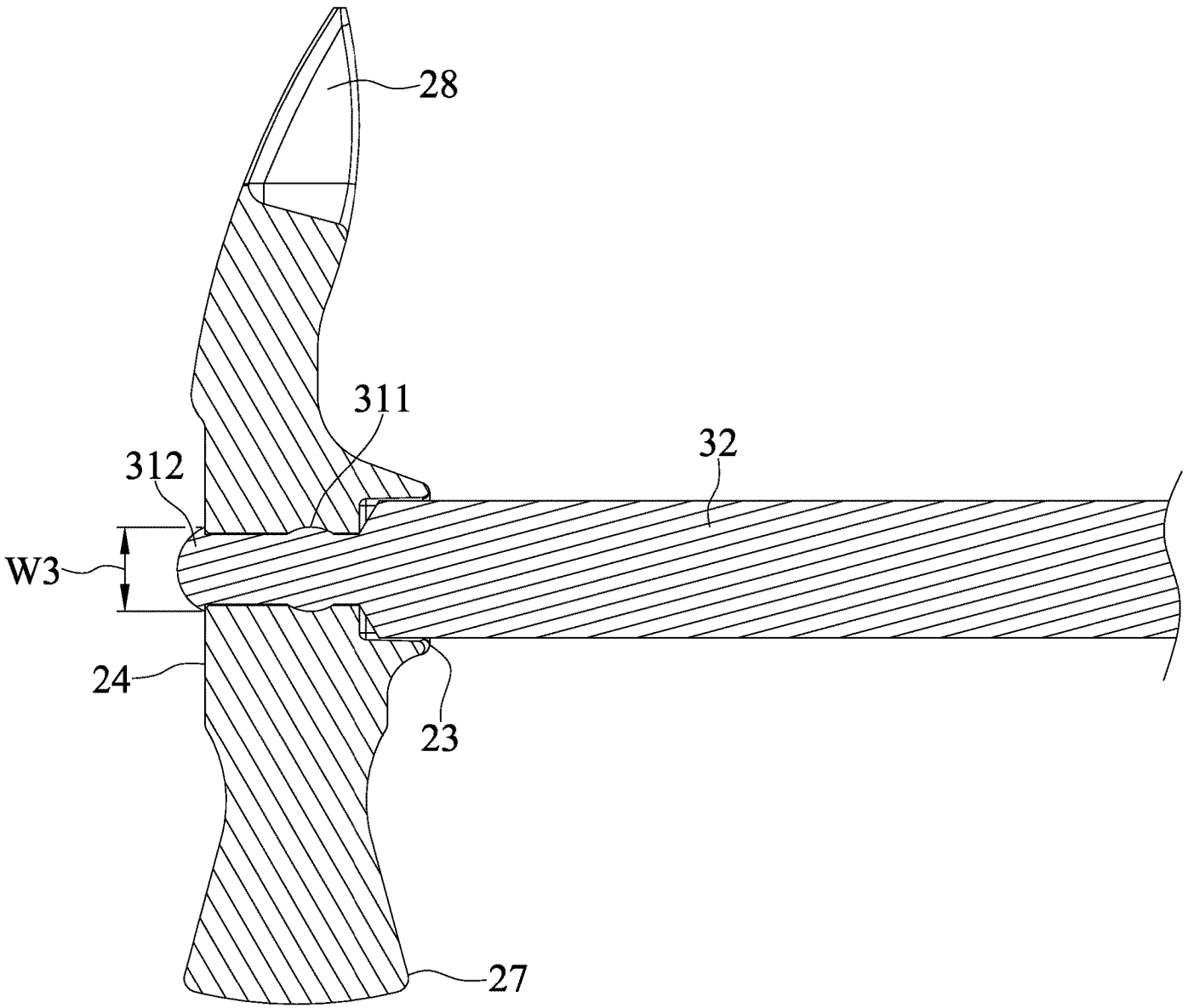
FIGS. 5 and 6 are cross-sectional views illustrating the handle secured to the handle and including a connecting end deformed.
Figure 6:
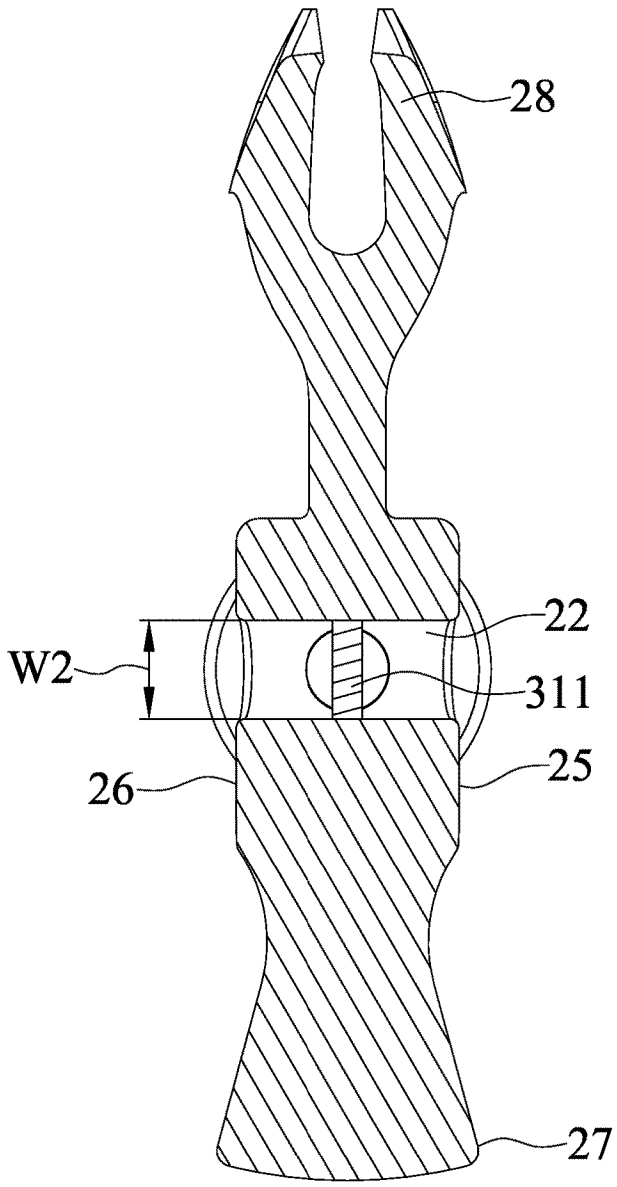

The handle 30 includes a connecting end 31 inserted through the through hole 21. The connecting end 31 has an outer periphery abutting against an inner periphery of the through hole 21. The connecting end 31 is extruded after inserting through the through hole 21 to include at least one positioning protrusion 311 protruding into the hole 22. The connecting end 31 is of a width W2 at where the at least one positioning protrusion 311 is disposed, as shown in FIG. 6. The width W2 extends in a radial direction of the connecting end 31. The width W2 is greater than the width W1. The width of the hole 22 substantially equals to the width W2 at where the at least one positioning protrusion 311 is disposed and so the at least one positioning protrusion 311 tightly abuts against an inner periphery of the hole 22. In addition, the connecting end 31 is extruded after inserting through the through hole 21 to include anti-disengagement protrusion 312 disposed outside the through hole 21. The anti-disengagement protrusion 312 is of a width W3, as shown in FIG. 5. The width W3 is greater than the width W1. The anti-disengagement protrusion 312 abuts against the end 24. The anti-disengagement protrusion 312 is therefore able to prevent the handle 30 detaching from the head 20.

The handle 30 has a main body made in one piece. The handle 30 has a grasp section 33 at an end. The connecting end 31 and the grasp section 33 are at opposite ends in a longitudinal direction of the handle 30. The grasp section 33 has an ergonomic cover mounted thereon. Preferably, the cover is injection molded.

The handle 30 can be positioned on the head 20. The head 20 defines at least one positioning recess for positioning a medial section 32 of the handle 30. The at least one positioning recess 231 has an opening formed on the end 23. The at least one positioning recess 231 is connected to and extends radially outwardly from the through hole 21. The medial section 32 includes an end thereof inserting in the at least one positioning recess 231. The combination of the through hole 21 and the at least one positioning recess 231 is of a non-circular cross section. The end of the medial section 32 is of a non-circular cross section. In the embodiment, the at least one positioning recess includes a positioning recess 231 and a positioning recess 232. The positioning recesses 231 and 232 are disposed separately from the hole 22, The positioning recesses 231 and 232 extend oppositely. The end of the medial section 32 inserts in the positioning recesses 231 and 232.

In view of the foregoing, once the head 20 and the handle 30 are tightly coupled with each other, they are prevented from moving relative to and disengaging from each other.

The foregoing is merely illustrative of the principles of this invention, and various modifications can be made by those skilled in the art without de parting from the scope and spirit of the invention.

What is claimed is:

1. A hammer tool comprising:

a head defining a through hole and a hole connected to the through hole, wherein the hole extends transversely to the through hole, and wherein the through hole is of a first width and the hole is of a width greater than the first width; and a handle tightly coupled to the head, wherein the handle includes a connecting end inserted through the through hole, wherein the connecting end is extruded after inserting through the through hole to include at least one positioning protrusion protruding into the hole, wherein the connecting end is of a second width at where the at least one positioning protrusion is disposed, wherein the second width is greater than the first width, wherein the head defines at least one positioning recess for positioning a medial section of the handle, wherein the at least one positioning recess is connected to and extends radially outwardly from the through hole, and wherein the medial section includes an end thereof inserting in the at least one positioning recess.

2. The hammer tool as claimed in claim 1, wherein the width of the hole substantially equals to the second width at where the at least one positioning protrusion is disposed, and wherein the at least: one positioning protrusion tightly abuts against an inner periphery of the hole.

3. The hammer tool as claimed in claim 2, wherein the connecting end abuts against an inner periphery of the through hole.

4. The hammer tool as claimed in claim 1, wherein the head has a first end and a second end at opposite ends and a first lateral side and a second lateral side at opposite sides, and wherein the through hole extends through the first and the second ends of the head and the hole extends through the first and the second lateral sides of the head respectively.

5. The hammer tool as claimed in claim 1, wherein the end of the medial section is of a non-circular cross section.

6. The hammer tool as claimed in claim 1, wherein the at least one positioning recess includes a first positioning recess and a second positioning recess extending oppositely, and wherein the end of the medial section inserting in the first and the second positioning recesses.

7. The hammer tool as claimed in claim 1, wherein the head has a first working portion at an end and a second working portion at another end, and wherein the first and the second working portions are disposed oppositely in a first direction and the through hole extends in a second direction transverse to the first direction.

8. The hammer tool as claimed in claim 7, wherein the first working portion has a striking face.

9. The hammer tool as claimed in claim 7, wherein the second working portion has a claw.

10. The hammer tool as claimed in claim 1, wherein the handle has a grasp section at an end, and wherein the connecting end and the grasp section are at opposite ends in a longitudinal direction of the handle.

11. The hammer tool as claimed in claim 10, wherein the grasp section is injection molded and covers the end of the handle.

12. A hammer tool comprising:

a head defining a through hole and a hole connected to the through hole, wherein the hole extends transversely to the through hole, and wherein the through hole is of a first width and the hole is of a width greater than the first width; and a handle tightly coupled to the head, wherein the handle includes a connecting end inserted through the through hole, wherein the connecting end is extruded after inserting through the through hole to include at least one positioning protrusion protruding into the hole, wherein the connecting end is of a second width at where the at least one positioning protrusion is disposed, wherein the second width is greater than the first width, wherein the anti-disengagement protrusion is of a third width greater than the first width, wherein the connecting end is extruded after inserting through the through hole to include anti-disengagement protrusion disposed outside the through hole, wherein the antis disengagement protrusion is of a third width greater than the first width, wherein the head defines at least one positioning recess for positioning a medial section of the handle, wherein the at least one positioning recess is connected to and extends radially outwardly from the through hole, and wherein the medial section includes an end thereof inserting in the at least one positioning recess.

13. The hammer tool as claimed in claim 12, wherein the head has a first end and a second end at opposite ends and the anti-disengagement protrusion abuts against the second end.

14. The hammer tool as claimed in claim 13, wherein the head has a first lateral side and a second lateral side at opposite sides, and wherein the through hole extends through the first and the second ends of the head and the hole extends through the first and the second lateral sides of the head respectively.

15. The hammer tool as claimed in claim 12, wherein the end of the medial section is of a non-circular cross section.

16. The hammer tool as claimed in claim 12, wherein the at least one positioning recess includes a first positioning recess and a second positioning recess extending oppositely, and wherein the end of the medial section inserting in the first and the second positioning recesses.

* * * * *